US010314359B2

(12) United States Patent
Richardson et al.

(10) Patent No.: US 10,314,359 B2
(45) Date of Patent: Jun. 11, 2019

(54) MOISTURE DISPLACEMENT SYSTEM FOR A VISOR

(71) Applicant: R.V. TECHNOLOGY LLP, Saltash, Cornwall (GB)

(72) Inventors: John Richardson, Devon (GB); Nicholas Vikentiou, Cornwall (GB)

(73) Assignee: R.V. TECHNOLOGY LLP (GB)

( * ) Notice: Subject to any disclaimer, the term of this patent is extended or adjusted under 35 U.S.C. 154(b) by 312 days.

(21) Appl. No.: 15/308,585

(22) PCT Filed: Mar. 26, 2015

(86) PCT No.: PCT/GB2015/050919

§ 371 (c)(1),
(2) Date: Nov. 2, 2016

(87) PCT Pub. No.: WO2015/145162

PCT Pub. Date: Oct. 1, 2015

(65) Prior Publication Data

US 2017/0119082 A1 May 4, 2017

(30) Foreign Application Priority Data

Mar. 27, 2014 (GB) ..... 1405545.3

(51) Int. Cl.

| | |
|---|---|
| ***A42B 3/12*** | (2006.01) |
| ***A42B 3/22*** | (2006.01) |
| ***A42B 3/26*** | (2006.01) |

(52) U.S. Cl.
CPC ..... *A42B 3/26* (2013.01); *A42B 3/125* (2013.01); *A42B 3/222* (2013.01)

(58) Field of Classification Search
CPC ..... A42B 3/26; A42B 3/125; A42B 3/222
USPC ..... 2/15, 171.4, 436
See application file for complete search history.

(56) References Cited

U.S. PATENT DOCUMENTS 4,514,864 A 5/1985 Huber

FOREIGN PATENT DOCUMENTS

| | | |
|---|---|---|
| DE | 3540930 | 5/1987 |
| DE | 20305977 | 7/2003 |
| FR | 2109042 | 5/1972 |

*Primary Examiner* — David Redding
(74) *Attorney, Agent, or Firm* — Galbreath Law Offices, P.C.; John A. Galbreath

(57) ABSTRACT

A visor (26) for a helmet (22) comprises: an air delivery element (34) for delivering air to a surface of the visor (26). The air delivery element (34) comprises: at least one inlet (28) for receiving air from an air source (30); and a plurality of outlets (44) through which air is transportable to the surface of the visor (26). The visor (26) may also include a ridge (84) formed adjacent to the plurality of outlets (44) for creating a Coanda effect in air passing through the plurality of outlets (44).

12 Claims, 12 Drawing Sheets

MOISTURE DISPLACEMENT SYSTEM FOR A VISOR

FIELD OF THE INVENTION

This invention relates to a visor for a helmet, a helmet incorporating a visor, and a moisture displacement system for a visor.

BACKGROUND TO THE INVENTION

A helmet, such as a motorcycle helmet, typically has a body portion and a visor. The body portion is formed from a padded portion and an outer shell, the padded portion being formed from a material suitable for absorbing an impact. In use, the helmet body fits over the head of a user, for example a motorcyclist, and the padded portion rests against the user's head. The helmet body typically has an opening which provides a viewing window for the wearer, and which is covered by a clear visor. In a typical motorcycle helmet, the visor is pivotally mounted to the body of the helmet such that it can be lifted from a first position, in which the visor is positioned in front of the wearer's eyes, into a second position, in which the visor is located above the opening of the viewing window.

A common problem for motorcyclists wearing helmets is that, when riding a motorcycle through precipitation, such as rain, water or mist droplets tend to form on an outer surface of the visor, which can obscure the vision of the rider.

When the rider is travelling at high speeds, the water and mist droplets tend to be urged towards side and bottom edges of the visor by the air hitting the visor. However, when the rider is travelling at low speeds, the air hitting the visor is typically not powerful enough to cause the water droplets to be forced to the edges of the visor. In order to regain clear vision through the visor, the rider typically has to use his or her hand or arm to wipe away the water droplets from the visor, or to lift the visor up so that the water droplets no longer obscure the view of the rider. However, it will be apparent that, if the visor is moved out of the line of vision of the rider, then wind and rain could blow into the rider's face, potentially further obscuring his or her view.

SUMMARY OF INVENTION

A first aspect of the invention provides a visor for a helmet, the visor comprising: an air delivery element for delivering air to a surface of the visor, the air delivery element comprising: a first channel for receiving air from an air source; a second channel having an outlet through which air is transportable to the surface of the visor; and a connector channel for connecting the second channel in fluid communication with the first channel.

The first channel, the second channel and the connector channel may be substantially circular in cross section. A cross sectional area of the connector channel may be smaller than a cross sectional area of the first channel and/or the second channel. The first channel and the second channel may be arranged substantially parallel to one another. The connector channel may be arranged substantially perpendicular to the first channel and/or to the second channel.

The outlet may comprise a slit.

The first channel may be formed within the visor, such that no portion of the first channel protrudes beyond the surface of the visor. The second channel may be formed in a lip which protrudes beyond the surface of the visor.

The visor may further comprise a ridge formed on the surface of the visor adjacent to the outlet, configured to create a Coanda effect in air passing through the outlet.

The outlet may be configured such that air can exit the outlet in a direction substantially parallel to the surface of the visor adjacent to the outlet.

The first channel may have a first end and a second end. Air from the air source may be received via the first end, and the second end may comprise an air barrier to prevent the flow of air beyond the second end of the first channel.

The visor further comprise a connector for connecting the visor to a helmet. The connector may be configured such that, when the visor is connected to a helmet, the visor is movable between a first configuration in which the transport of air via the connector to the air delivery element is permitted, and a second configuration in which the transport of air via the connector to the air delivery element is restricted. The connector may be a pivotable connector for pivotally connecting the visor to a helmet.

A second aspect of the invention provides a visor for a helmet, the visor comprising: an air delivery element for delivering air to a surface of the visor, the air delivery element comprising: at least one inlet for receiving air from an air source; and a plurality of outlets through which air is transportable to the surface of the visor; and a ridge formed adjacent to the plurality of outlets for creating a Coanda effect in air passing through the plurality of outlets.

The visor may further comprise a connector for connecting the visor to a helmet. The connector may be configured such that, when the visor is connected to a helmet, the visor is movable between a first configuration in which the transport of air via the connector to the air delivery element is permitted, and a second configuration in which the transport of air via the connector to the air delivery element is restricted.

The connector is may be a pivotable connector for pivotally connecting the visor to a helmet.

The at least one inlet may comprise: at a first end, a first inlet for receiving air from an air source; and at a second end, a second inlet for receiving air from the air source.

A third aspect of the invention provides a visor for a helmet, the visor comprising: an air delivery element for delivering air to a surface of the visor; a connector for connecting the visor to a helmet; and a channel formed in the connector for transporting air from an external source via the connector to the air delivery element; wherein the connector is such that, when the visor is connected to a helmet, the visor is movable between a first configuration in which the transport of air via the connector to the air delivery element is permitted, and a second configuration in which the transport of air via the connector to the air delivery element is restricted.

The connector may be a pivotable connector for pivotally connecting the visor to a helmet.

The air delivery element may be a manifold and comprises: at a first end, a first inlet for receiving air from an air source; at a second end, a second inlet for receiving air from the air source; and a plurality of outlets through which air is transportable to the surface of the visor.

The visor may further comprise a ridge formed adjacent to the plurality of outlets for creating a Coanda effect in air passing through the plurality of outlets.

A fourth aspect of the invention provides a helmet comprising: a body; and a visor as described above.

The helmet body may comprise a padded portion and an outer shell. The helmet may comprise a helmet conduit for delivering air to the air delivery element. The helmet conduit may be mounted within the shell. The helmet conduit may be at least partially embedded within the padded portion of the helmet body.

The helmet conduit may comprise an inlet for receiving air from an air source, and at least one outlet for delivering air to the air delivery element. The helmet conduit may comprise a first outlet for delivering air a first end of the air delivery element, and a second outlet for delivering air a second end of the air delivery element. The helmet conduit may be formed integrally with the helmet body.

A fifth aspect of the invention provides a moisture displacement system for a helmet visor, the moisture displacement system comprising: a helmet as described above; an air source; a conduit for transporting air between the air source and the helmet. The air source may comprise an air pump. The air source may be mountable to a vehicle. The air source may be configured to receive power from the vehicle, and may be controllable using a controller formed integrally with, or mounted on, the vehicle. The conduit may be detachably connectable to the helmet.

It will be appreciated that the features of the various aspects of the invention may be combined with those of other aspects of the invention.

BRIEF DESCRIPTION OF THE DRAWINGS

Embodiments of the invention will now be described, strictly by way of example only, with reference to the accompanying drawings, of which.

DESCRIPTION OF THE EMBODIMENTS

Figure 1:
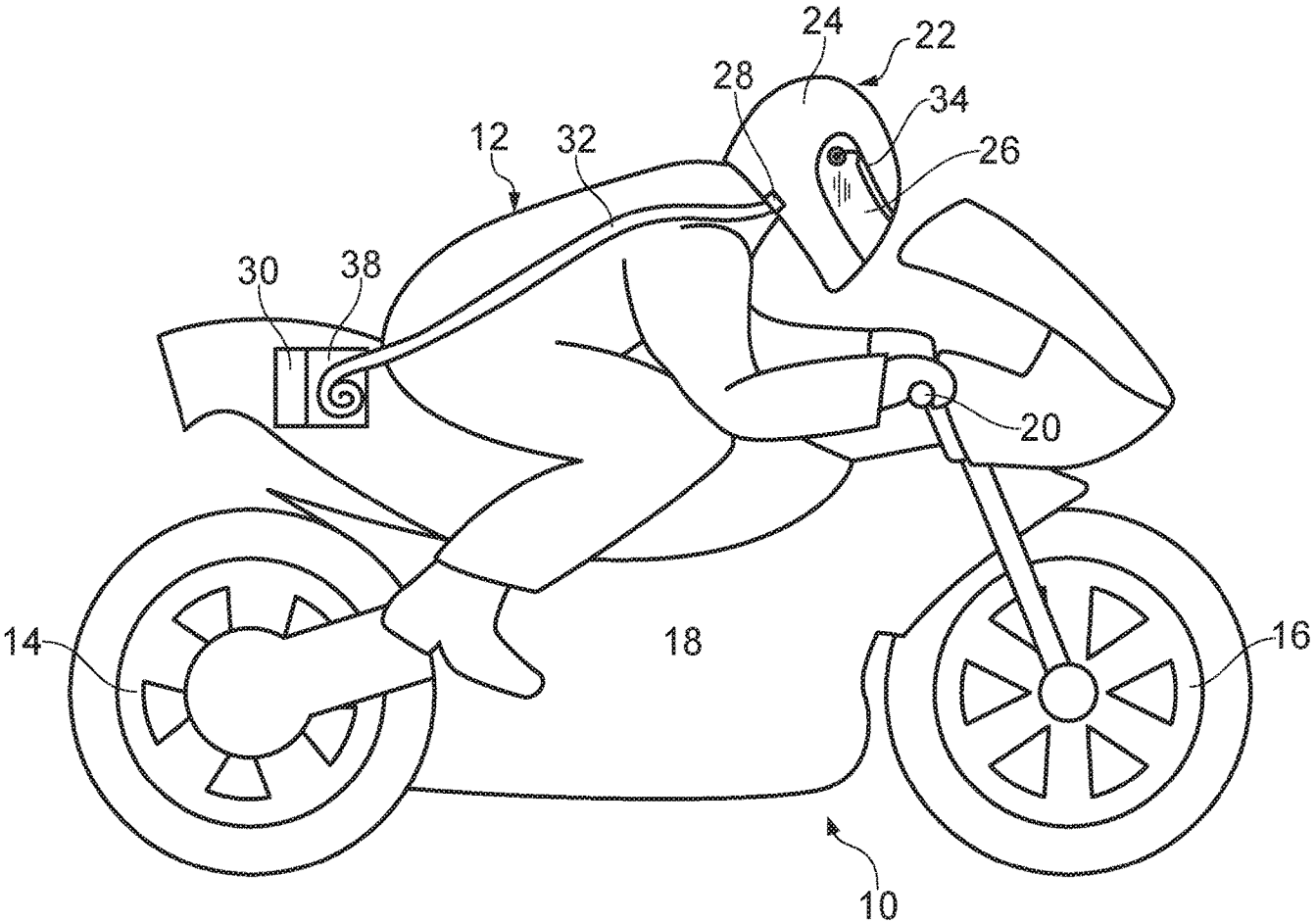
FIG. 1 is a side view of a motorcycle and a motorcyclist wearing a helmet and visor constructed in accordance with an embodiment of the invention.

Referring to the drawings, FIG. 1 shows a motorcycle 10 and a rider 12 on the motorcycle. It will be appreciated that, while the invention is described, in this embodiment, in the context of a motorcyclist 12 riding a motorcycle 10, the invention is applicable to other vehicles such as scooters, bicycles, karts, cars, buggies, and the like.

The motorcycle 10 includes a rear wheel 14, a front wheel 16, a motorcycle body 18 and handle bars 20. It will be appreciated that the motorcycle 10 includes a number of additional components which are not essential for understanding this invention. For example, the motorcycle also includes an engine (not shown) located within the body 18.

The rider 12 wears a helmet 22 formed of a helmet body 24 and a visor 26. The construction of the helmet 22 will be discussed in more detail with reference to FIGS. 2 and 3. A port 28 extends from a base of the helmet body 24 of the helmet 22, and is connected to an air pump 30 via tubing, or an umbilical 32. The umbilical 32 is formed from flexible material, such as rubber, and is coupled at a first end to the air pump 30, and at a second end to the helmet 22 via the port 28. The air pump 30 is configured to pump air along the umbilical 32 to the helmet 22. The port 28 is connected to a manifold, or air delivery element, 34 which is mounted on, or formed integrally with, the visor 26. A connection is formed between the port 28 and the air delivery element 34 for delivery of the pumped air to the air delivery element, as will be discussed with reference to FIGS. 2 and 3.

In use, air from the air pump 30 is pumped along the umbilical 32 to the air delivery element 34. The air delivery unit 34 directs the air onto a surface of the visor 26 and serves to displace moisture, such as water or mist droplets, present on the surface of the visor 26 which may be obscuring the view of the rider.

In this embodiment, the air pump is configured to pump the air in a pulsed manner. In other embodiments, however, the air pump 30 may pump air in a continuous manner. The pulsed air delivery is preferred, since pulsed air is more effective in removing moisture from the visor.

Figure 2A:
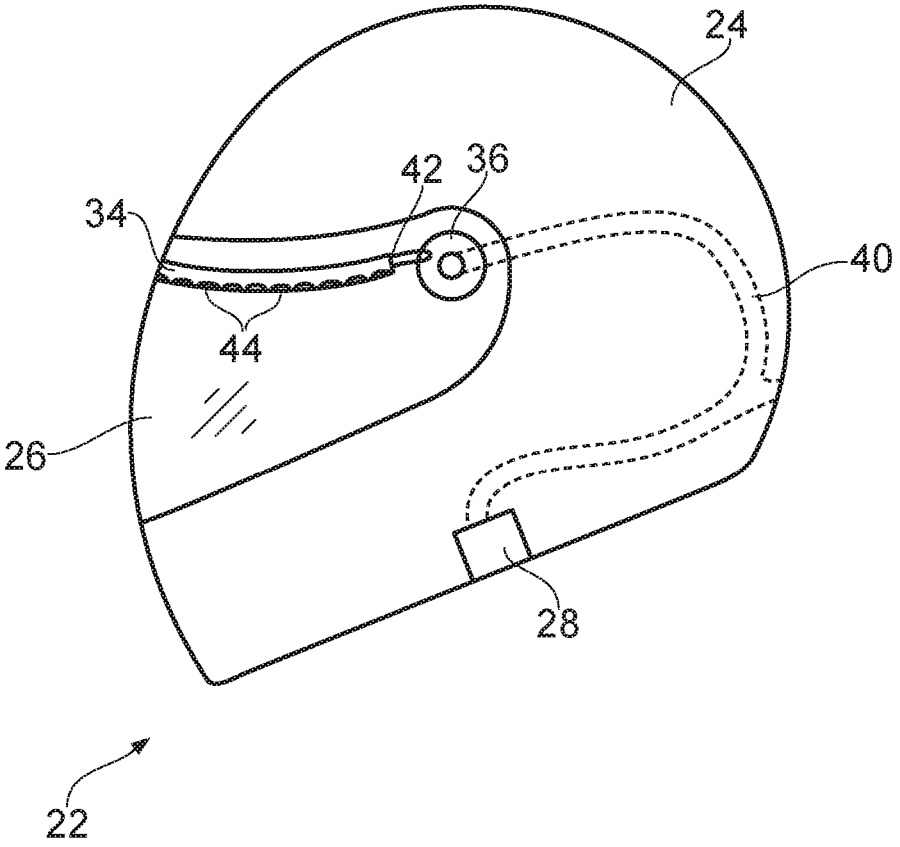
FIG. 2A is a side view of a helmet constructed in accordance with an embodiment of the invention, the helmet being in a first configuration.
Figure 2B:
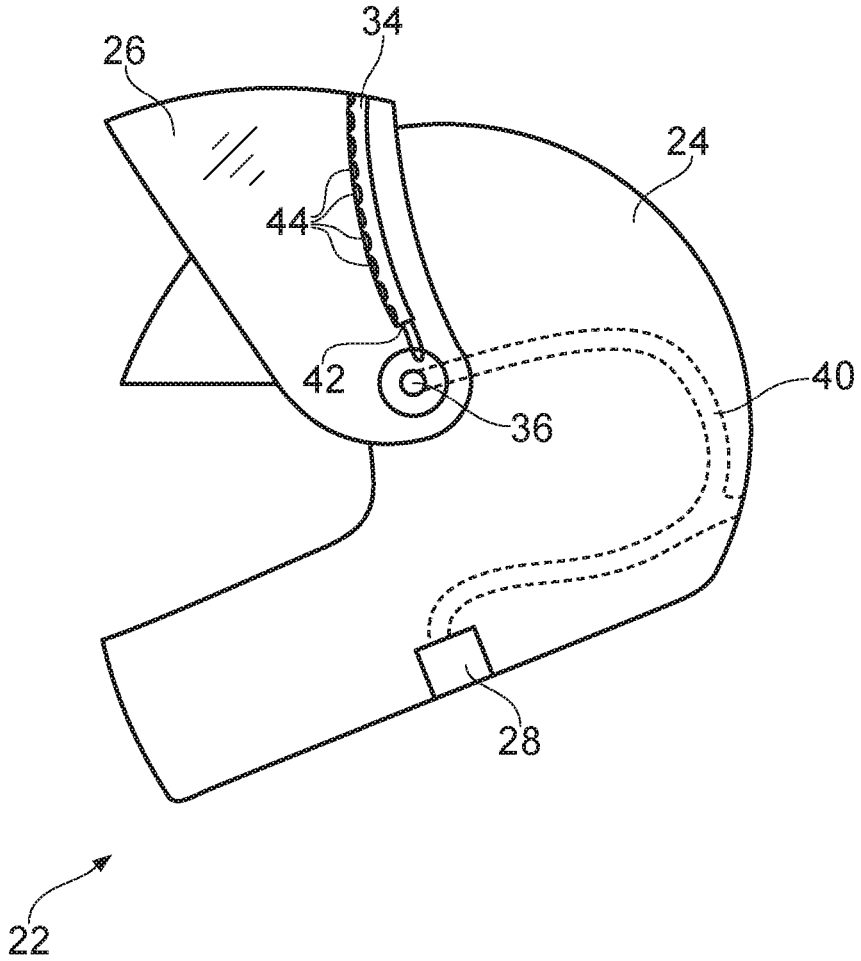
FIG. 2B is a side view of the helmet of FIG. 2A in a second configuration.

The helmet 22 will now be described in greater detail with reference to FIGS. 2 and 3. FIGS. 2A and 2B are side views of the helmet 22. The visor 26 is pivotally connected to the helmet body 24 by a pair of connectors 36 (only one connecter is visible in FIGS. 2A and 2B). The connectors 36 allow the visor 26 to be moved between a first, closed configuration, as shown in FIG. 2A, and a second, open configuration, as shown in FIG. 2B. A motorcyclist 12 typically uses a helmet 22 in the closed configuration shown in FIG. 2A when he or she is riding a motorcycle 10, as the visor 26 acts as a barrier for preventing wind, moisture and debris from entering his or her eyes. When the motorcycle 10 is not in motion, for example when the motorcyclist has reached his or her destination, then he or she might move the visor 26 into the second, open configuration, as shown in FIG. 2B.

In some embodiments, the connectors 36 are formed integrally with the helmet body 24. In other embodiments, the connectors 36 are separate units which are configured to fit into complementary apertures or recesses formed in the helmet body 24.

The umbilical connection port 28 is located on one side of the helmet 22, adjacent to the base of the helmet. In this description, the base of the helmet is considered to be that part of the helmet in which is formed an opening for receiving the head of the motorcyclist 12. In other words, the port 28 is located at a lower side of the helmet such that, in use, the port 28 is relatively close to the motorcycle 10. The port 28 may be any known port or means for connecting together two portions of pipe or tubing. For example, the port 28 may be any snap-fit connector. Ideally, the port 28 is configured to receive the umbilical 32 by pushing the umbilical into the port. The act of pushing the umbilical 32 into the port 28 causes the umbilical to snap into place, for example with a click so that a user can identify when the umbilical has been fitted correctly into the port. The port 28 is also preferably configured such that the umbilical 32 is releasable from the port if sufficient force is applied. For example, if the umbilical 32 is pulled in a direction substantially downwards or sideways from the port 28, then the umbilical can break away from the port, thereby disconnecting the umbilical from the helmet 22. This arrangement acts as a safety mechanism so that, if the motorcyclist 12 is involved in an accident, whereby he or she falls off the motorcycle 10, then the umbilical 32 is released from the port 28, preventing any restriction on the movement of the motorcyclist's head.

With reference again to FIG. 1, the umbilical 32 is shown connected to the air pump 30 which is attached to the motorcycle 10. The umbilical 32 may be connected to the air pump using a port similar to the port 28 described above. Alternatively, a more permanent connection may be used. In some embodiments, the umbilical 32 is stored wound on a reel 38. The reel 38 is an auto-winding reel, which is configured to automatically wind the umbilical 32 when the umbilical is not in use. When a motorcyclist 12 needs to connect the umbilical 32 to his or her helmet 22, he or she pulls the umbilical towards the helmet, thereby unwinding the umbilical from the reel 38. When the umbilical 32 has been unwound to a sufficient length, the motorcyclist 12 can plug the umbilical into the port 28 on the helmet 22. When a connection between the umbilical 32 and the helmet 22 is no longer required, such as at the end of a ride, the motorcyclist releases the umbilical from the helmet, and allows the reel 38 to automatically wind up the umbilical for storage.

While, in FIG. 1, the reel 38 and the air pump 30 are shown mounted to the rear of the motorcycle 10, it will be appreciated that either or both of the air pump and the reel may be mounted elsewhere on the motorcycle, particularly on the body 18 of the motorcycle. In some embodiments, the air pump 30 is configured to receive power from the engine of the motorcycle. In other embodiments, however, the air pump 30 receives power from an auxiliary power source, such as a battery (not shown) mounted on the motorcycle 10.

Referring again to FIGS. 2A and 2B, the port 28 is shown in fluid communication with the connector 36 via a helmet conduit 40, denoted by a dashed line. While only one connector 36 is visible in FIGS. 2A and 2B, it will be appreciated that the port 28 is also in fluid communication with the connector located on the opposite side of the helmet 22, again via the helmet conduit 40. In one embodiment, the helmet conduit 40 is at least partially embedded within an internal padded portion (not shown in FIG. 2) of the helmet 22. In other embodiments, the helmet conduit 40 may be located between the padded portion of the helmet 22 and an outer shell of the helmet. The helmet conduit 40 may be formed integrally with the helmet body 24, for example by moulding the conduit onto or into the padded portion or the outer shell of the helmet.

The manifold 34 is, in one embodiment, an elongate structure formed at, or near to, a top edge of the visor 26. In other embodiments, the manifold 34 is formed integrally with the visor 26, and may be positioned elsewhere on the visor, for example separated from the top edge. The manifold 34 will be discussed in greater detail with reference to FIGS. 6 and 7. In general, however, the manifold 34 is a tubular member having an inlet 42 at each end and a plurality of outlets 44 spaced at least partially along the length of the manifold. The inlets 42 of the manifold 34 may be connected to the connectors 36 directly or via additional pipes 45. Air can be transported into the manifold via the air inlets 42, and can exit the manifold via air outlets 44. Air fed through the manifold 34 is directed, via the outlets 44 onto a surface of the visor 26.

Each of the inlets 42 of the manifold 34 is connected to one of the pair of connecters 36. In one embodiment, a channel (not shown in FIGS. 2A and 2B) is formed in the connector 36 such that, when the visor 26 is closed, in the configuration shown in FIG. 2A, then air is able to flow from the helmet conduit 40 to the manifold 34, but when the visor is lifted and moved into the open configuration, shown in FIG. 2B, the arrangement of the connectors 36 is such that the passage between the helmet conduit 40 and the manifold 34 is at least partially blocked, restricting the flow of air to the manifold. Instead of flowing through the manifold 34, air is caused to flow through an exit aperture (not shown) in the connectors 36.

Figure 3:
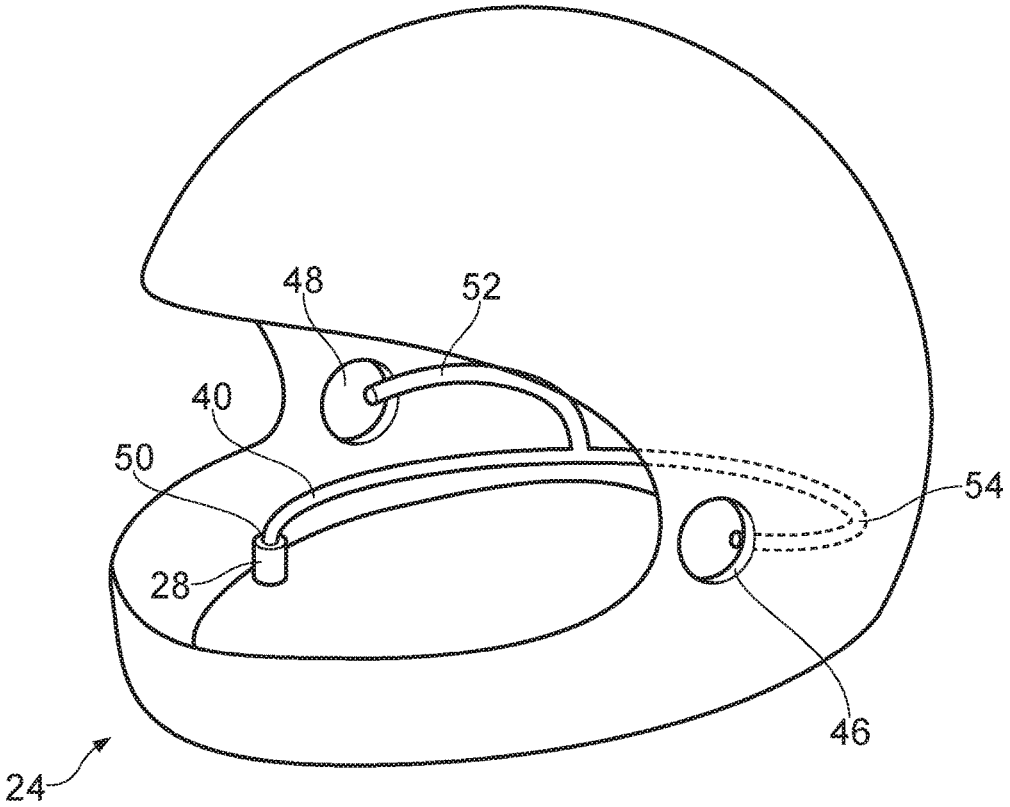
FIG. 3 is a perspective view of a body of the helmet of FIGS. 2A and 2B.

FIG. 3 shows the body 24 of the helmet 22 without the visor 26 and connectors 36. The helmet conduit 40 is shown extending from the port 28 around an inner surface of the helmet body 24 towards openings 46, 48 in the sides of the helmet body. The openings 46, 48 are shaped to receive the connectors 36 for connecting the visor 26 to the helmet body 24.

From FIG. 3, it can be seen that the helmet conduit 40 is substantially 'T' or 'Y'-shaped with an inlet portion 50 connected to the port 28, a first arm 52 configured and positioned to connect to a first of the pair of connectors 36, and a second arm 54 configured and positioned to connect to a second of the pair of connectors 36. By forming the helmet conduit 40 in a fork-shape, with the first and second arms 52, 54, it is possible to ensure that the pressure of air entering each of the inlets 42 of the manifold 34 is substantially equal. This serves to maintain a relatively constant air pressure along the length of the manifold 34.

While, in some embodiments, the port 28 may be located on the left-hand side of the helmet body 24, in other embodiments, the port may be located on the right-hand side of the helmet body. Alternatively, the port 28 may be located at or near to the front or back of the helmet body 24. By locating the port 28 near to the base of the helmet body 24, a motorcyclist 12 is able to locate the port easily and to plug the umbilical 32 into the port after mounting the motorcycle 10. The user may, for example, use a side-mounted wing mirror on the motorcycle 10 to aid the location of the port 28 on the helmet 22.

Figure 4:
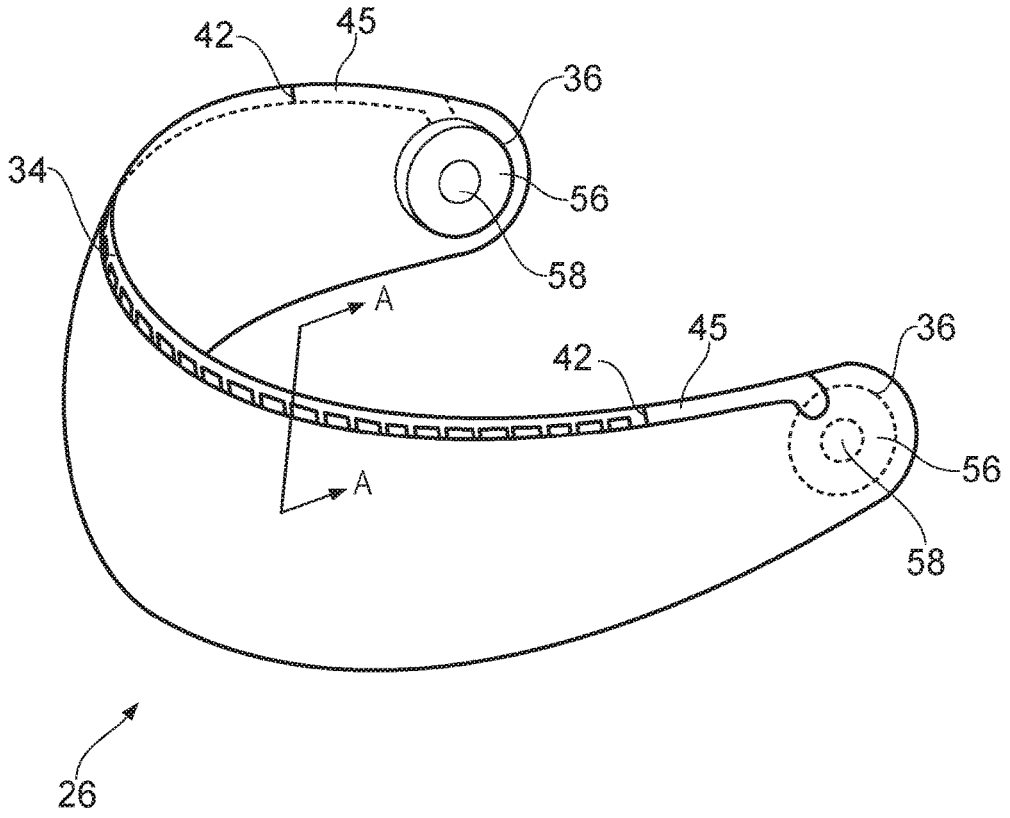
FIG. 4 is a perspective view of a visor of the helmet of FIGS. 2A and 2B.

FIG. 4 shows the visor 26 with a connector 36 located near to each end of the visor. The connectors 36 may be formed integrally with the visor 26, or fitted to the visor through apertures formed therein (not shown). The manifold 34 extends around an upper edge of the visor 26, and is connected to the connecter 36 at each end. The structure of the connectors will be described in detail with reference to FIG. 5. In general, however, in this embodiment, each connector is formed of an outer part 56 that is fixedly attached to the visor 26, and an inner part 58 that is fixedly attached in the openings 46, 48 in the helmet body 24.

Figure 5:
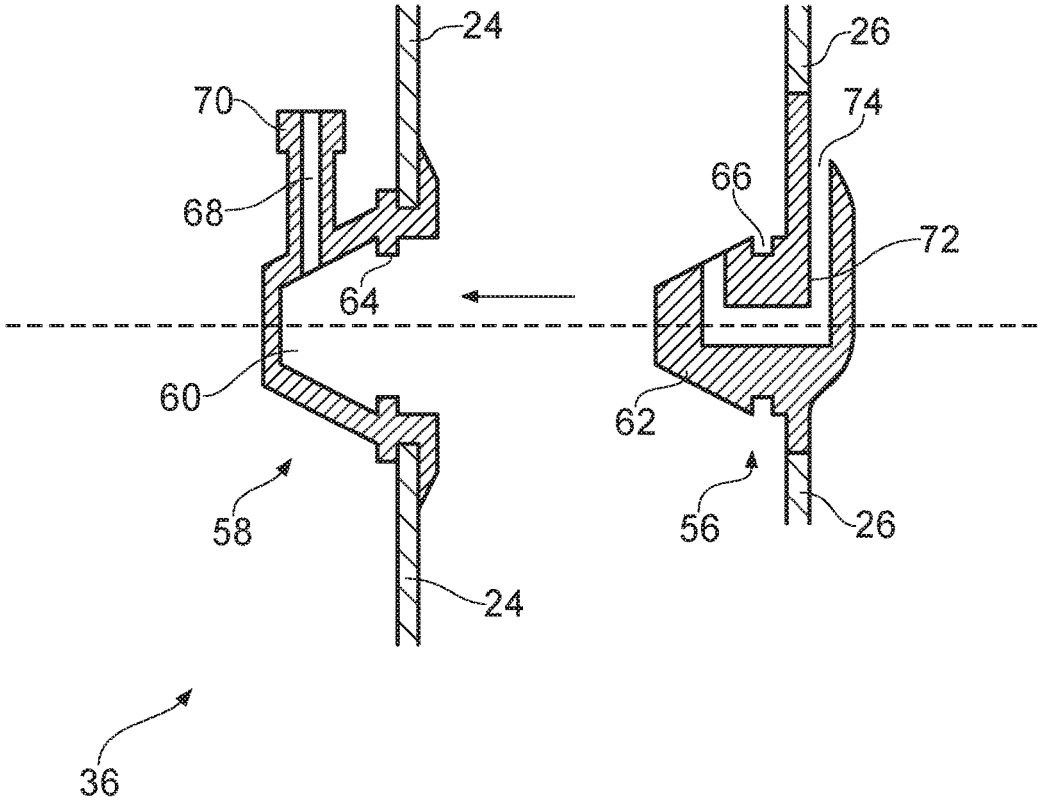
FIG. 5 is a sectional view of a mechanism for connecting the visor of FIG. 4 to the helmet body of FIG. 3 according to a first embodiment of the invention.

Referring now to FIG. 5, a sectional view of the connector 36 according to one embodiment of the invention is shown. In this embodiment, the outer part 56 and the inner part 58 of the connector 36 may be attached respectively to the visor 26 and to the helmet body 24 by a strong adhesive. The inner part 58 has a recess 60 configured to receive a complementary shaped projection 62 of the outer part 56. When the projection 62 of the outer part 56 is pushed sufficiently far into the recess 60 of the inner part 58, a rim 64 formed around a periphery of the inner part 58 can engage with and click into a complementary shaped channel 66 formed around a periphery of the projection 62, thereby connecting the outer part to the inner part and, therefore, the visor 26 to the helmet body 24. In this embodiment, the projection 62 and the recess 60 are substantially frusto-conical in shape. However, it will be appreciated that the projection 62 and the recess 60 could have any suitable complementary shapes.

An inner fluid channel 68 feeds into the recess 60 through a connection pipe 70. The connection pipe 70 is arranged to connect to the helmet conduit 40 for receiving air from the umbilical 32 and the air pump 30.

An outer fluid channel 72 is formed in the outer part 56 of the connector 36, from a wall of the projection 62 to an outlet 74. The outlet 74 can be connected to the inlet 42 of the manifold 34 directly, or via an additional pipe or tube, such as the pipe 45 (see FIG. 4). The outer fluid channel 72 is shaped and positioned such that, when the outer part 56 is connected to the inner part 58, and the visor 26 is in its closed configuration as shown in FIG. 2A, the inner fluid channel 68 and the outer fluid channel 72 are in alignment, and air is able to flow from the connection pipe 70 to the outlet 74. However, when the visor 26 is moved into its second configurations as shown in FIG. 2B, the inner fluid channel 68 and the outer fluid channel 72 are not aligned, and the flow of air from the connection pipe 70 to the outlet 74 is restricted.

Figure 6:
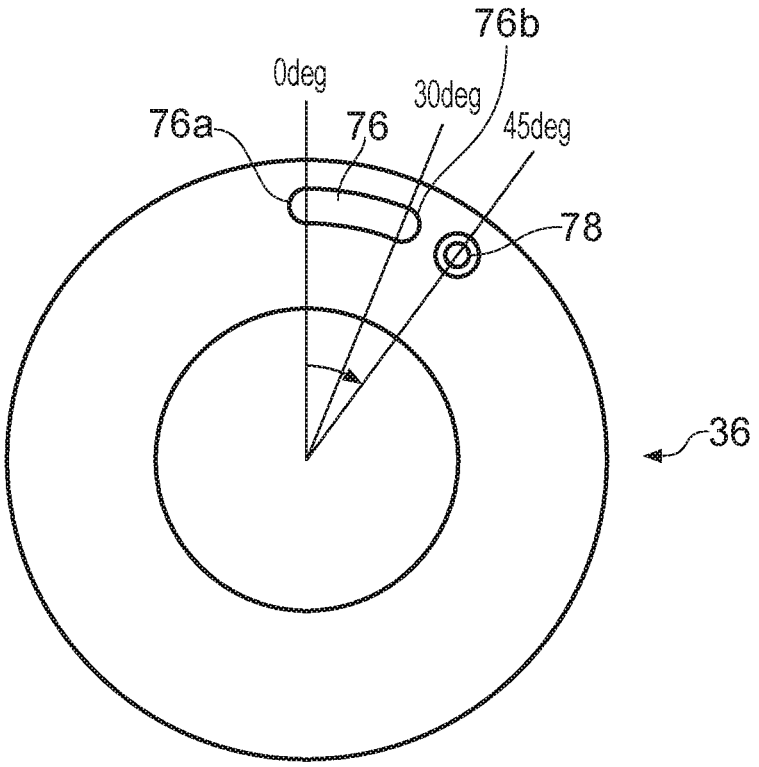
FIG. 6 is a side view of a mechanism for connecting the visor of FIG. 4 to the helmet body of FIG. 3 according to a second embodiment of the invention.
Figure 7:
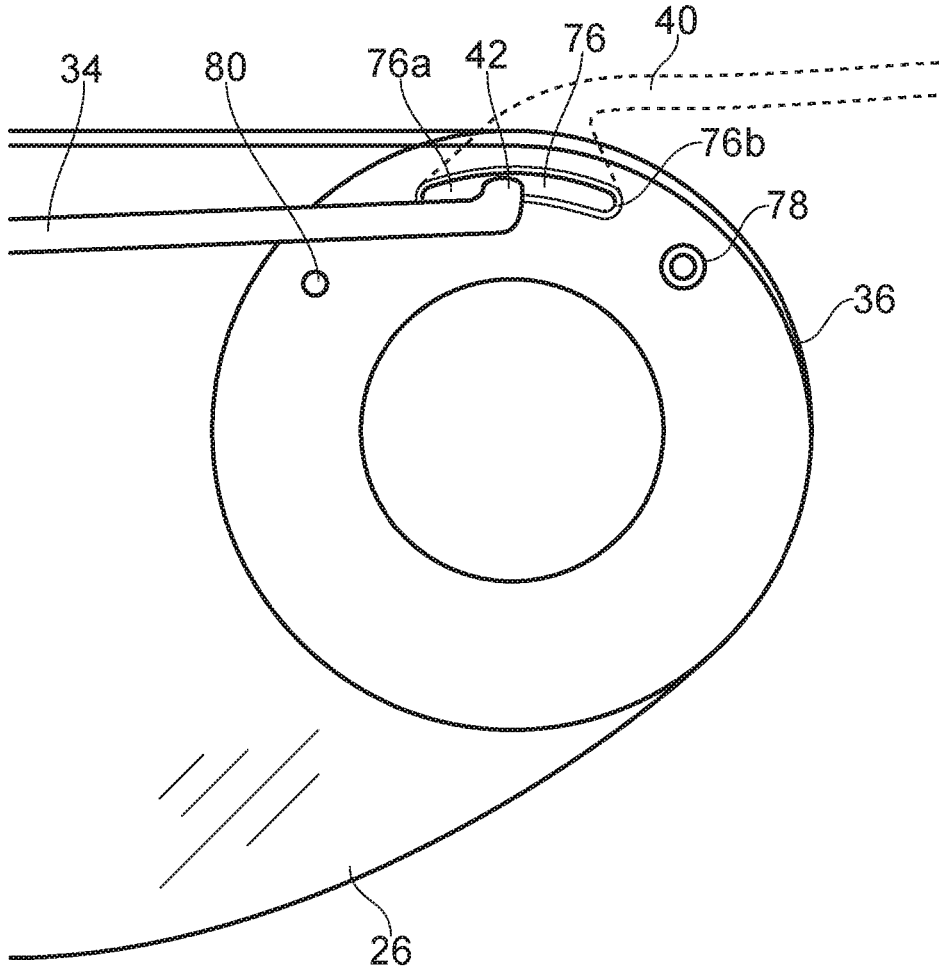
FIG. 7 is a side view of the mechanism of FIG. 6, connected to the visor of FIG. 4.

FIG. 6 shows the connector 36 according to another embodiment of the invention. In this embodiment, the connector 36 includes an elongate aperture 76 through which air is able to pass and an air barrier region 78. In FIG. 7, the connector 36 is shown attached to the visor 26. The manifold 34 on the visor 26 terminates with the air inlet 42 at the aperture 76 of the connector 36. The helmet conduit 40, shown with a dashed line, also terminates at the aperture 76 of the connector 36 such that air is able to pass from the helmet conduit, through the aperture in the connector, and via the air inlet 42 into the manifold 34.

The connector 36, as is described above, allows the visor 26 to pivot relative to the helmet body 24. In this embodiment, the visor 26 can be pivoted through an angle of approximately 45 degrees. Thus, when the visor 26 is in its closed position, it is considered to be in an unrotated position, and the air inlet 42 of the manifold 34 is located at a first end 76*a* of the elongate aperture 76, in line with the line marked "0deg" in FIG. 6. As the visor 26 is rotated clockwise (opening the visor), the air inlet 42 of the manifold 34 moves along the length of the elongate aperture 76. Air will continue to flow from the helmet conduit 40 through the aperture 76 and into the manifold 34 until the air inlet 42 reaches a second end 76*b* of the elongate aperture 76, which represents a rotation of approximately 30 degrees, as indicated in FIG. 6. As the visor 26 is opened further, the air inlet 42 of the manifold 34 is rotated beyond the end 76*b* of the elongate aperture 76. The connector 36 forms a barrier between the helmet conduit 40 and the air inlet 42 and, consequently, air is unable to flow from the helmet conduit into the manifold 34. Instead, air flows from the helmet conduit 40, through the elongate aperture 76, and through a venting aperture 80 formed in the visor 26. When the visor 26 is opened to its full extent, its rotation relative to the helmet body 24 is approximately 45 degrees from its original, closed position. In its open position, the end of the manifold 34 engages with the air barrier region 78.

The arrangement of the connector 36 in this embodiment causes air to flow from the helmet conduit 40 into the manifold 34 when the visor is in its closed position or when the visor is opened by a small amount (through a rotation of around 30 degrees), but the air flow into the manifold is restricted when the visor is fully open.

Figure 8:
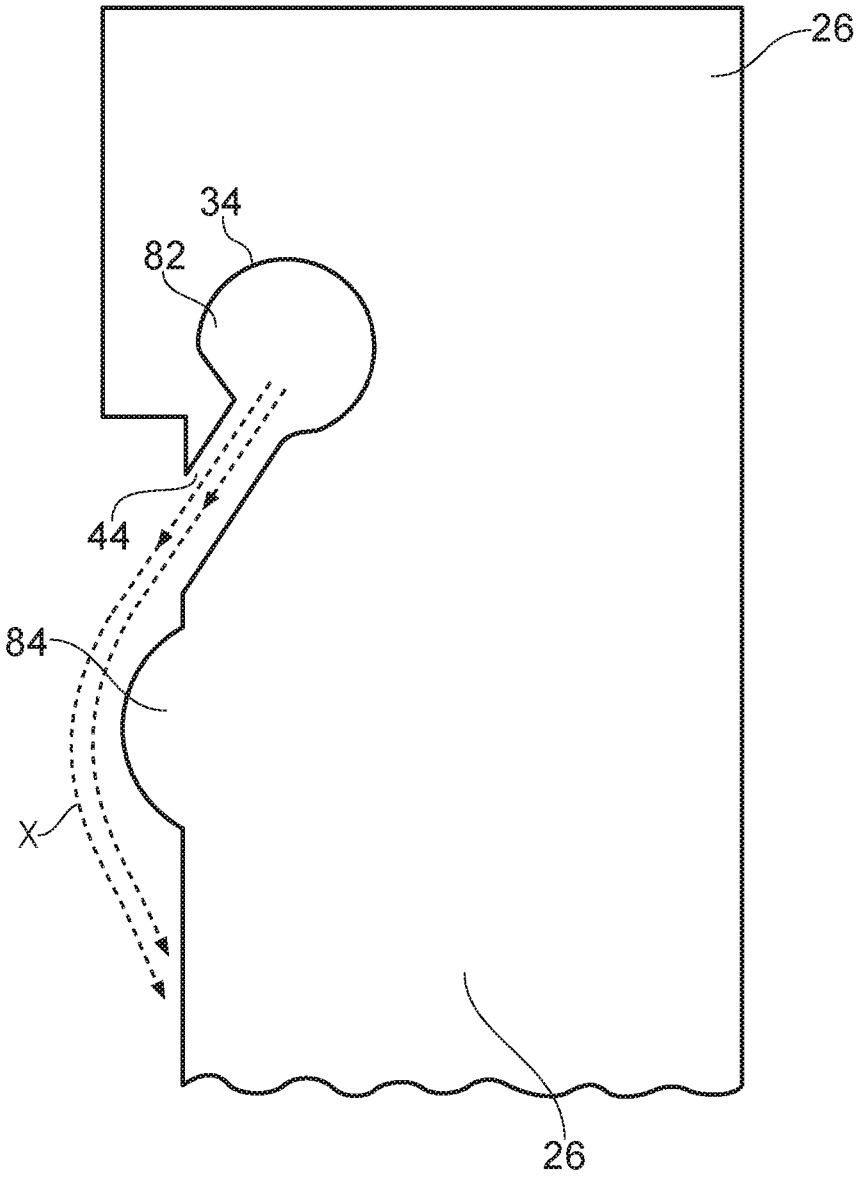
FIG. 8 is a sectional view of a portion of a moisture displacement system constructed in accordance with an embodiment of the invention.

FIG. 8 is a sectional view through the manifold 34 and the visor 26, along the line A-A of FIG. 4. The manifold 34 is formed near to a top edge of, and integrally with, the visor 26. In other embodiments, the manifold 34 may be formed at the top edge of the visor 26, and formed separately from and connected to (i.e. not formed integrally with) the visor. A channel 82 extends along the length of the manifold 34, and the plurality of outlets 44 are formed in a bottom wall of the manifold. In this embodiment, a ridge 84, or Coanda strip, is formed immediately below, and along the length of, the manifold 34, but the ridge may be formed lower down the visor 26 such that there is a gap between the manifold and the ridge. In other embodiments, a plurality of individual protrusions might be formed below the manifold, each protrusion being located below one of the plurality of outlets 44. As air passes through the outlet 44 towards the surface of the visor 26, it passes over the ridge or protrusion 84. The ridge 84 causes the air to travel in a path shown by the arrows X, due to an effect known as the Coanda effect, which causes fluid to be attracted to a surface. In this way, the air passing through the outlet or outlets 44 is less likely to flow away from the visor and, instead, is drawn towards the surface of the visor as it flows downwards. Consequently, the moisture removal effect by the air is likely to be more effective.

In some embodiments, instead of the plurality of outlets 44, a single outlet may be formed in the manifold 34, in the form of a slit, along at least part of the length of the manifold. In this way, air is able to flow out of the manifold in the form of a blade or curtain of air rather than in the form of a plurality of individual jets of air.

FIG. 8 shows an outlet 44 of the manifold 34 oriented such that air is able to flow out of the outlet in a direction away from the surface of the visor. As is explained above, the ridge 84 formed near to the outlet 44 causes air leaving the outlet to be drawn towards the surface of the visor due to the Coanda effect. In some embodiments, each outlet 44 is formed and/or oriented such that air is able to flow out of the outlet in a direction substantially parallel to the surface of the visor. Again, in these embodiments, the ridge 84 causes air flowing out of each outlet to be drawn towards the surface of the visor due to the Coanda effect.

Figure 9:
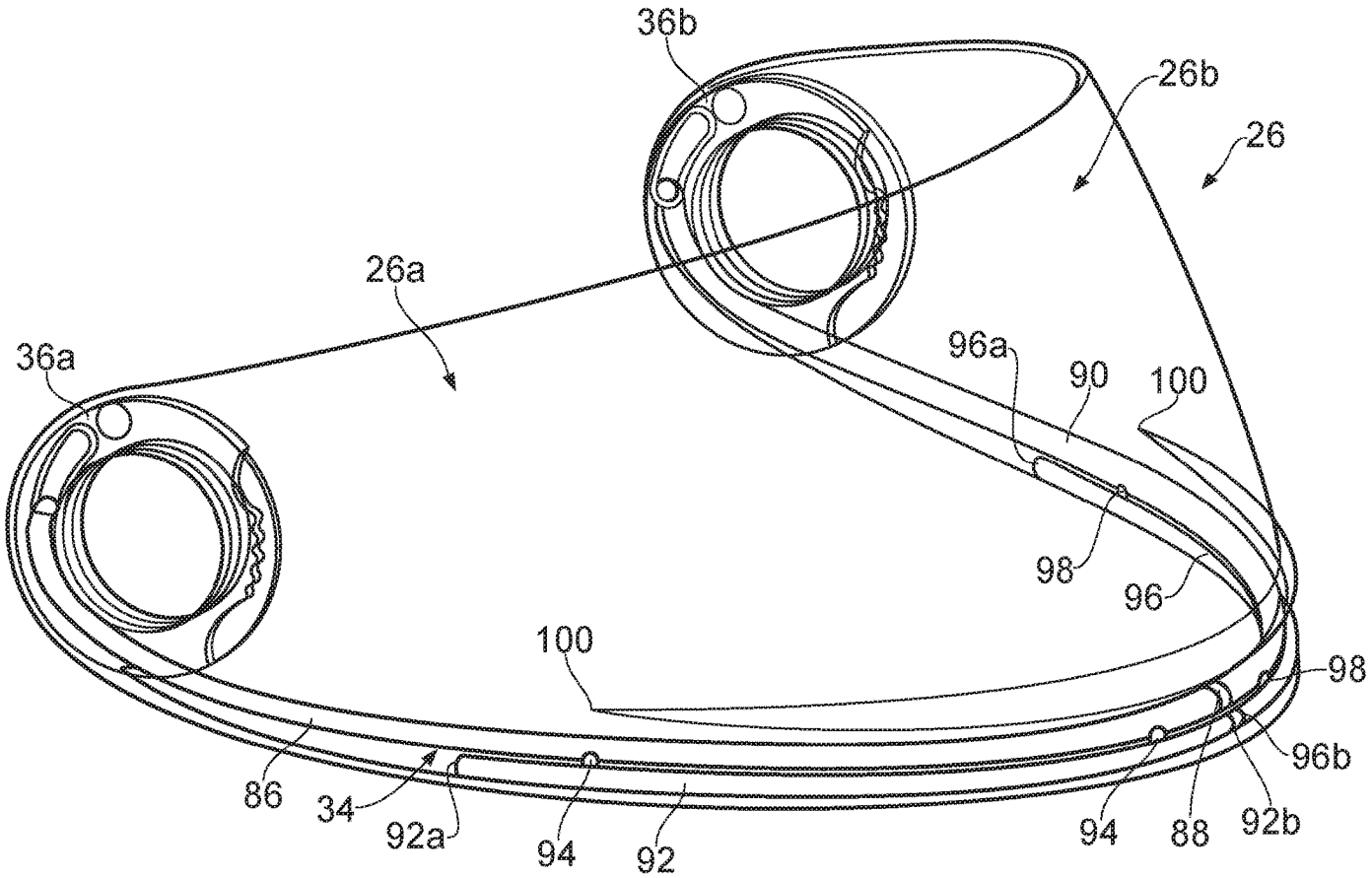
FIG. 9 is a perspective view of a visor constructed in accordance with a further embodiment of the invention.
Figure 10:
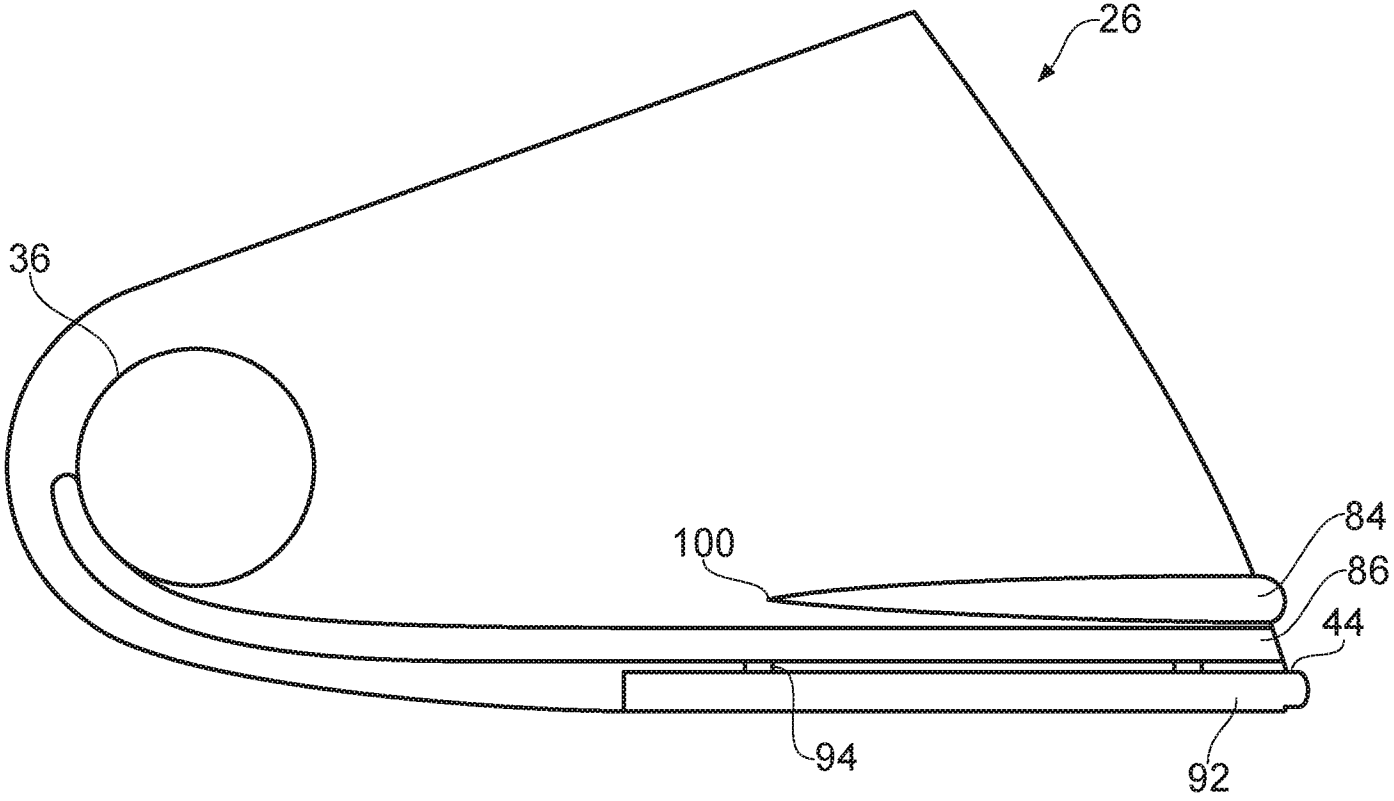
FIG. 10 is a side view of the visor of FIG. 9.
Figure 11:
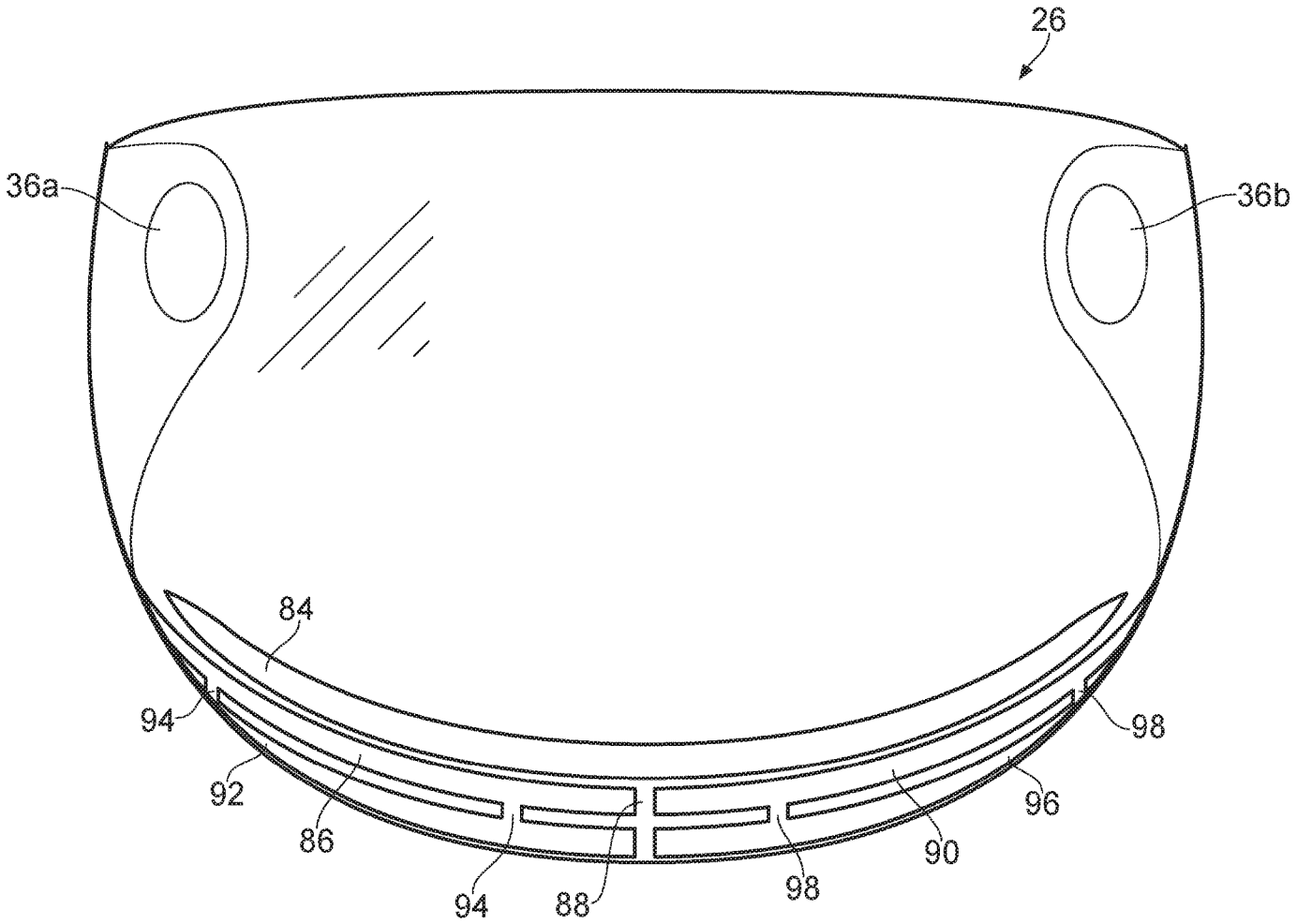
FIG. 11 is a front view of the visor of FIGS. 9 and 10.

In FIGS. 2A, 2B and 4, the air delivery element, or manifold, 34 is shown to be located near to the top of the visor 26, with one or more outlets 44 positioned such that air is able to flow over the visor surface towards a bottom edge of the visor. However, as is mentioned above, the manifold 34 may be positioned elsewhere on the visor 26. FIGS. 9, 10 and 11 show an embodiment of the invention in which the visor 26 includes a manifold 34 which is formed at, or near to, a bottom edge of the visor. In this embodiment, air can be directed from outlets in the manifold 34 over the ridge 84 towards a top edge of the visor.

In this embodiment, the manifold 34 is formed of a plurality of pathways or channels. The connectors 36, via which the visor 26 can be connected to a helmet are, in FIGS. 9 and 11, labelled 36*a* and 36*b*. A first connector 36*a* is located on a first side 26*a* of the visor, and a second connector 36*b* is located on a second, opposite side 26*b* of the visor. A first air delivery channel 86 is in fluid communication with the first connector 36*a* such that air can flow via the first connector into the first air delivery channel. The first air delivery channel 86 terminates at an air barrier 88, which is located substantially centrally on along the length of the visor. That is to say, the air barrier 88 is located at approximately the midway point on the visor with respect to the first connector 36*a* and the second connector 36*b*. A second air delivery channel 90 is in fluid communication with the second connector 36*b* such that air can flow via the second connector into the second air delivery channel. The second air delivery channel 90 also terminates at the air barrier 88, such that air is not able to flow between the first and second air delivery channels 86, 90.

A first air exit channel 92 is located, in this embodiment, beneath the first air delivery channel 86, and is in fluid communication with the first air delivery channel via a first pair of connector channels 94. In this embodiment, air is able to flow from the first air delivery channel 86 into the first air exit channel 92 via the two connector channels 94. However, in other embodiments, a single connector channel 94 or more than two connector channels may be provided to enable air to flow between the first air delivery channel 86 and the first air exit channel 92. The first air exit channel 92 has closed ends 92*a* and 92*b*. The closed end 92*b* is substantially aligned with the air barrier 88, at approximately the midway point on the visor with respect to the first connector 36*a* and the second connector 36*b*.

Similarly, a second air exit channel 96 is located, in this embodiment, beneath the second air delivery channel 90, and is in fluid communication with the second air delivery channel via a second pair of connector channels 98. In this embodiment, air is able to flow from the second air delivery channel 90 into the second air exit channel 96 via the two connector channels 98. However, in other embodiments, a single connector channel 98 or more than two connector channels may be provided to enable air to flow between the second air delivery channel 86 and the second air exit channel 96. The second air exit channel 96 has closed ends 96*a* and 96*b*. The closed end 96*b* is substantially aligned with the air barrier 88, at approximately the midway point on the visor with respect to the first connector 36*a* and the second connector 36*b*. The air delivery channels 86, 90 are, in this embodiment, formed entirely within the visor, such that no portion of the air delivery channels protrudes from the surface of the visor.

In this embodiment, the connector channels 94, 98 are spaced apart from one another and each connector channel is spaced apart from an end of the air exit channel 92, 96. Consequently, the connector channels 94, 96 nearest to the air barrier 88 are also spaced apart from the air barrier. This arrangement enables air to gather in a volume of the air delivery channels between the connector channel and the air barrier 88, in a so-called "dead end" region, before it flows through the connector channels into the air exit channels 92, 96. This amplifies the rate of flow of the air through the connector channels.

In this embodiment, the connector channels 94, 98 are oriented such that they are substantially perpendicular to the air delivery channels 86, 90 and to the air exit channels 92, 96. In other words, the connector channels 94, 98 are configured such that air flowing through them flows in a direction substantially perpendicular to the general direction in which air is able to flow through the air delivery channels 86, 90 and the air exit channels 92, 96. In other embodiments, the connector channels 94, 98 may be arranged in a different orientation.

Each of the air exit channels 92, 96 includes an outlet 44 formed substantially along its length. Each outlet 44 is in the form of a slit which is configured to direct air from the air exit channels 92, 96 in a direction substantially parallel to the surface of the visor 26 at the outlet. As can be seen from FIG. 10, the air exit channels 92, 96 are formed within a lip which protrudes outwards slightly from the surface of the visor 26 to enable the outlet 44 to direct the air in the desired direction (that is, parallel to the surface of the visor at the outlet). However, the air delivery channels 86, 90 are, in this embodiment, formed within the visor 26 itself, and do not protrude beyond the surface of the visor.

The arrangement of an outlet 44 being located on each side of the visor 26 provides an even distribution of air over the central portion of the visor surface, which is the area most desired to be cleared of moisture.

Each of the air delivery channels 86, 90 and the air exit channels 92, 96 has a substantially circular cross-section with a diameter of between around 4 mm and 6 mm and, preferably, with a diameter of approximately 5 mm. Each of the connector channels 94, 98 also has a substantially circular cross-section, but has a diameter which is slightly less than that of the air delivery channels 86, 90 and the air exit channels 92, 96. For example, each of the connector channels 94, 98 may have a cross-sectional diameter of between around 3 mm and 5 mm, and preferably of approximately 4 mm. By forming the connector channels 86, 90 with a diameter which is slightly smaller than the diameter of the air delivery channels 86, 90 and the air exit channels 92, 96, air is able to flow into the air exit channels at a greater rate, and under greater pressure, than the air flowing into the air delivery channels.

The first air delivery channel 86 extends from the first connector 36*a* positioned near to the first end of the visor, to the air barrier 88. Similarly, the second air delivery channel 90 extends from the second connector 36*b* positioned near to the second end of the visor, to the air barrier 88. However, the first air exit channel 92, which includes the outlet or outlets 44 extends only around a front portion of the visor 26 below the first air delivery channel 86, from the first end 92*a* to the second end 92*b* and, similarly, the second air exit channel 96 extends only around a front portion of the visor 26 below the second air delivery channel 90, from the first end 96*a* to the second end 96*b*. This arrangement enables air to be directed onto the portion of the surface of the visor which, in use, is substantially in front of the user's eyes, but air is not directed onto the side portions of surface of the visor, near to the connectors 36*a*, 36*b*, where a clear visor surface is not needed.

FIG. 11 shows a front view of the visor 26, with the air barrier 88 positioned so as to prevent air from flowing from the air inlet (42, FIG. 7) in the first connector 36*a* (located on the left hand side of the visor as it is viewed in FIG. 11) into the second air delivery channel 90 on the right hand side of the visor in FIG. 11. The air barrier 88 also prevents air from flowing from the air inlet (42, FIG. 7) at the second connector 36*b* (located on the right hand side of the visor 26 as it is viewed in FIG. 11) into the first air delivery channel 86 on the left hand side of the visor in FIG. 11.

The air barrier 88 is provided to prevent turbulence which might otherwise be caused by a collision of air flowing in the first air delivery channel 86 from the first connector 36*a* with air flowing in an opposite direction in the second air delivery channel 90 from the second connector 36*b*. When air flowing through the first or second air delivery channels 86, 90 encounters the air barrier 88, its flow rate through the channel is reduced dramatically, and the pressure of air in the upper channel is increased such that air flows more readily through the connector channels 94, 98 into the air exit channels 92, 96.

In the embodiment shown in FIGS. 9, 10 and 11, the ridge 84 is formed above the air delivery channels 86, 90. The ridge 84 has a substantially semi-circular cross section. As can be seen in FIGS. 9 and 10, the width of the ridge 84 is greatest in the centre of the visor, where the ridge has a width of around 5 mm to 11 mm, and preferably a width of approximately 8 mm. The diameter of the cross section of the ridge 84 reduces towards its ends, such that the ridge 84 tapers to a point 100 at either end. The reason for the width and height of the ridge decreasing as the ridge extends around the sides of the visor is to compensate for the difference in the shape and profile of the visor from its centre to its sides. Near to the sides of the visor, a smaller ridge 84 is capable of creating a sufficient Coanda effect in the air flowing from the outlets 44.

The combination of the helmet 22, the air pump 30 and means for delivering air from the air pump to the visor 26 of the helmet can be considered to be a moisture displacement system.

Various modifications to the embodiments described above will be apparent to those skilled in the relevant field. For example, in one alternative embodiment, the air pump 30 may be activated automatically. In one embodiment, the air pump 30 is switched on automatically if the speed of the motorcycle to which it is attached increases beyond a predetermined level. Similarly, the air pump 30 may be switched off automatically if the speed of the motorcycle falls below the predetermined level.

It will be apparent to those skilled in the art that the visor and helmet body may be constructed as separate and independent entities. A visor constructed in accordance with the present invention may be fitted to any suitable helmet body having a conduit suitable for delivering air to the manifold of the visor. Accordingly, it will be appreciated that the visor may be manufactured and marketed independently of the helmet body. Alternatively, a visor and helmet body may be marketed together as a complete helmet system. In a further alternative, the visor and helmet system may be marketed together with an air source and conduit for delivering air from the air source to the helmet.

So far, the invention has been described in terms of individual embodiments. However, those skilled in the art will appreciate that various embodiments of the invention, or features from one or more embodiments, may be combined as required. It will be appreciated that various modifications may be made to these embodiments without departing from the scope of the invention, which is defined by the appended claims.

The invention claimed is:

1. A moisture displacement system for a helmet visor, the moisture displacement system comprising:

a helmet which includes a helmet body;

a visor which includes an air delivery element for delivering air to an outer surface of the visor, a connector for connecting the visor to the helmet, and a channel formed in the connector for transporting air from an external air source via the connector to the air delivery element; wherein the connector is such that, when the visor is connected to the helmet, the visor is movable between a first configuration in which the transport of air via the connector to the air delivery element is permitted, and a second configuration in which the transport of air via the connector to the air delivery element is restricted;

an air source which includes an air pump; and a conduit for transporting air between the air source and the helmet.

2. A moisture displacement system for a helmet visor according to claim 1, wherein the connector is a pivotable connector for pivotally connecting the visor to a helmet.

3. A moisture displacement system for a helmet visor according to claim 1, wherein the air delivery element is a manifold and comprises:

at a first end, a first inlet for receiving air from an air source;

at a second end, a second inlet for receiving air from the air source; and a plurality of outlets through which air is transportable to the surface of the visor.

4. A moisture displacement system for a helmet visor according to claim 1, wherein the helmet body comprises a padded portion and an outer shell, and wherein the helmet comprises a helmet conduit for delivering air to the air delivery element, the helmet conduit being mounted within the shell.

5. A moisture displacement system for a helmet visor according to claim 4, wherein the helmet conduit is at least partially embedded within the padded portion of the helmet body.

6. A moisture displacement system for a helmet visor according to claim 4, wherein the helmet conduit is formed integrally with the helmet body.

7. A moisture displacement system for a helmet visor according to claim 1, wherein the helmet conduit comprises an inlet for receiving air from an air source, and at least one outlet for delivering air to the air delivery element.

8. A moisture displacement system for a helmet visor according to claim 7, wherein the helmet conduit comprises a first outlet for delivering air a first end of the air delivery element, and a second outlet for delivering air a second end of the air delivery element.

9. A moisture displacement system for a helmet visor according to claim 1, wherein the conduit is detachably connectable to the helmet.

10. A moisture displacement system for a helmet visor according to claim 1, wherein the air source is mountable to a vehicle.

11. A moisture displacement system for a helmet visor according to claim 1, wherein the air source is configured to receive power from the vehicle, and is controllable using a controller formed integrally with, or mounted on, the vehicle.

12. A moisture displacement system for a helmet visor according to claim 1, wherein the air delivery element comprises a plurality of outlets which are oriented such that air is able to flow out of the outlet in a direction substantially parallel to an adjacent surface of the visor.

* * * * *